United States Patent [19]

Triolo et al.

[11] Patent Number: 5,018,500

[45] Date of Patent: May 28, 1991

[54] PRESSURE REGULATOR DEVICE FOR THE FUEL CIRCUIT OF AN INTERNAL COMBUSTION ENGINE SUPPLY SYSTEM

[75] Inventors: Innocenzo Triolo, Casalecchio di Reno; Rino Stagni, S. Pietro in Casale, both of Italy

[73] Assignee: Weber s.r.l., Turin, Italy

[21] Appl. No.: 441,881

[22] Filed: Nov. 27, 1989

[30] Foreign Application Priority Data

Nov. 25, 1988 [IT] Italy ..... 68054 A/88

[51] Int. Cl.[5] ..... F02M 41/00

[52] U.S. Cl. ..... 123/463; 123/456; 137/510

[58] Field of Search ..... 123/463, 460, 456, 467, 123/457; 137/510; 251/356, 357, 358

[56] References Cited

U.S. PATENT DOCUMENTS

| | | | |
|---|---|---|---|
| 4,231,347 | 11/1980 | Ohumi | 137/510 |
| 4,237,924 | 12/1980 | Benjamin | 137/510 |
| 4,357,921 | 11/1982 | Ciaccio | 123/463 |
| 4,431,026 | 2/1984 | Fehrenbach | 137/510 |
| 4,615,320 | 10/1986 | Fehrenbach | 123/467 |
| 4,741,315 | 5/1988 | Fehrenbach | 123/463 |
| 4,756,288 | 7/1988 | Bonfigioli | 123/463 |
| 4,805,575 | 2/1989 | de Concini | 123/460 |
| 4,825,835 | 5/1989 | Deweerdt | 123/463 |
| 4,903,667 | 2/1990 | Sonnenmoser | 123/456 |

FOREIGN PATENT DOCUMENTS

| | | |
|---|---|---|
| 0233697 | 8/1987 | European Pat. Off. . |
| 2013838 | 8/1979 | United Kingdom . |

*Primary Examiner*—Carl Stuart Miller

*Attorney, Agent, or Firm*—Jeffers, Hoffman & Niewyk

[57] ABSTRACT

The device comprises a housing formed by a cup-shaped body and a bell-shaped cover secured to the body, a deformable membrane secured to the housing and forming, together with the body, a chamber for the fuel, a movable shutter member designed to bring the chamber into communication with an outlet opening; the device is characterized in that at least one hole is provided in the base wall of the body for the inlet of the fuel into the chamber and a bearing seat for a sealing ring arranged so that it can be interposed between the seat and a corresponding seat of a housing in which the lateral wall of the body is inserted is provided on the lateral wall of the body.

8 Claims, 1 Drawing Sheet

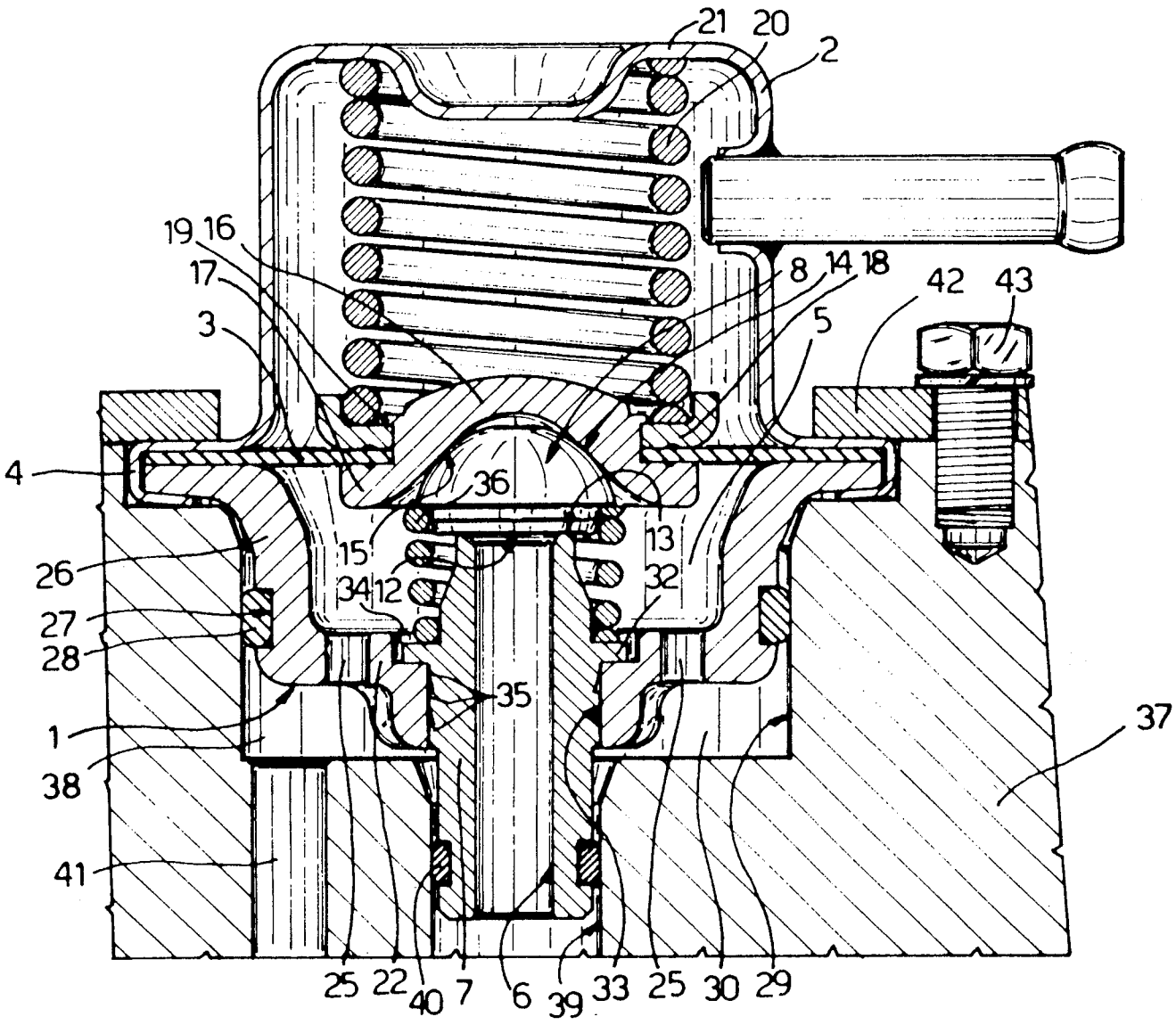
37
43
42
18
14
8
5
2
20
21
29
30
25
33
39
6
7
40
22
25
13
32
35
36
12
34
15
19
16
17
3
4
26
27
28
1
38
41

PRESSURE REGULATOR DEVICE FOR THE FUEL CIRCUIT OF AN INTERNAL COMBUSTION ENGINE SUPPLY SYSTEM

BACKGROUND OF THE INVENTION

The present invention relates to a pressure regulator device adapted to regulate the fuel pressure in a fuel circuit of an internal combustion engine supply system.

As is known these devices are designed to keep the fuel pressure substantially constant within the circuit and comprise a housing formed by a cup-shaped body and a bell-shaped cover which is secured to this body, a deformable membrane secured to the housing and defining, together with the body, a chamber for the fuel and a movable shutter member adapted to bring this chamber into communication with an outlet opening. The shutter member has a working surface arranged to bear on an appropriate seat so as to control the flow of the fuel through the outlet opening and also comprises a surface which bears on a corresponding surface of a plate connected to the deformable membrane and held against the shutter member by a spring.

When the fuel pressure within the chamber exceeds a predetermined value, a force is applied to the deformable membrane, which force is enough to overcome the elastic reaction of the spring so as to allow the separation of the working surface of the shutter member from its seat and, therefore, the discharge of a certain quantity of fuel through the outlet opening.

Regulator devices of the type described above have some drawbacks.

In the first instance, they are rather complex and therefore expensive because of the large number of components constituting them; in addition to the basic components listed above, others are needed for the satisfactory operation of the device; a sleeve inserted in an appropriate hole is normally secured in the cup-shaped body so that the fuel can be supplied within the chamber defined by this body; in addition, the seat on which the working surface of the shutter member bears is normally obtained on a ring of appropriate material which is connected to a bushing in which the outlet opening for the fuel is obtained and which is secured, for instance by welding, in an axial perforation in the body. Numerous components are also provided for the mechanical fastening of some components to others as well as members providing leak-tightness between the components.

Moreover, the sealing action which the shutter member of the device exerts, when in its closed position, is not always very efficient. This is due to the fact that the bearing between this shutter member and the plate secured to the deformable membrane is not very correct with the result that the resultant of the pressures exchanged between the plate and the shutter member does not coincide strictly with the axis of the shutter member itself; this is principally due to the fact that the above-mentioned surface of the plate on which the shutter member bears lacks precision, since it is obtained by conventional mechanical machining operations with the removal of material.

SUMMARY OF THE INVENTION

The object of the present invention is to provide a pressure regulator device of the type described above which is free of the drawbacks discussed and which is therefore much simpler from a structural point of view and is smaller and substantially more reliable in operation.

The present invention provides a pressure regulator device adapted to regulate the fuel pressure in a fuel circuit of an internal combustion engine fuel supply system, which device comprises a housing formed by a cup-shaped body and a bell-shaped cover secured to this body, a deformable membrane secured to the housing and defining, together with the body, a chamber for the fuel, a movable shutter member adapted to bring the chamber into communication with an outlet opening, the shutter member comprising a surface which bears on a corresponding bearing surface of a plate connected to the membrane and held against this shutter member by a spring, characterized in that at least one hole for the supply of the fuel to the chamber is provided in the base wall of the body and a bearing seat for a sealing ring adapted to be interposed between this seat and a corresponding seat of a housing in which the lateral wall of the body is inserted is provided on the lateral wall of this body.

BRIEF DESCRIPTION OF THE DRAWING

The device of the invention will now be set out in further detail, by way of example, with reference to the attached drawing which shows an axial section through the device.

DETAILED DESCRIPTION OF THE INVENTION

The device substantially comprises a cup-shaped body 1 and a bell-shaped cover 2 secured to the body, a deformable membrane 3, whose peripheral edge is locked between the body and the cover by plastic deformation of the peripheral edge 4 of the latter.

The membrane defines, together with the body 1, a chamber 5 for the fuel which communicates externally through a hole 6 provided in a sleeve 7 and whose passage aperture is controlled by a movable shutter member 8. The latter has a substantially plane working surface 12 adapted to bear against a corresponding annular seat 13 obtained at the end of the sleeve 7; this member is then bounded by a substantially spherical surface 14 which is adapted to bear against a corresponding support surface 15 obtained on a plate 16 secured in any way to the deformable membrane 3; this fastening can take place in the manner shown in the Figure, by locking the radially inner edge of the membrane between an annular edge 17 of the plate and a ring 18 which is held in position by plastic deformation of the material of the plate 16 so as to obtain a projection 19.

A helical spring 20 is interposed between the base wall 21 of the cover 2 and the plate 16 so as to hold the latter against the shutter member 8.

According to the invention, at least one axial hole 25 which is adapted to allow the fuel to enter the chamber 5 is provided in the base wall 22 of the body 1, while a seat 27 for a sealing ring 28 which is interposed between this seat and a corresponding seat 29 of a housing 30 in which the lateral wall of the body is inserted is provided on the outer surface of the lateral wall 26 of the body itself; the seat 27 advantageously comprises an annular groove in which the sealing ring 28 is housed, as shown in the Figure.

According to the invention, the support surface 15 of the plate 16 is a curved surface which is obtained by a coining operation; as is known this operation is carried out by pressing a coining tool against the surface, which tool applies very high pressures to the surface.

The surface 15 is generated geometrically by rotation about an axis of a curve which has two curved sections with opposite curvatures separated by a flexure; this axis of rotation is obviously the axis of the device and the curved line generating the surface is the line which is clearly visible in the section of the Figure.

According to the invention, the sleeve 7 is provided with an annular collar 32 and this sleeve is fixed, by forced coupling, in an axial hole 33 obtained in the base wall 22 of the body 1; the annular collar 32 is housed in a corresponding annular seat 34 of this base wall. Annular projections 35, each one having a frustoconical shape adapted to improve the forced connection between the sleeve 7 and the surface of the hole 33, are advantageously provided on the outer lateral surface of the sleeve 7. The body 1 is formed by metal material injected under pressure into a die using the moulding technique known as pressure die-casting; as an alternative this body is formed from punched steel or drawn sheet.

The cover 2 is also formed from sheet which is drawn and folded by plastic deformation operations.

The device also comprises, a second helical spring 36 coaxial with the sleeve 7 and interposed between the collar 32 and the shutter member 8; this spring is centred on a portion of the outer surface of the sleeve itself, as can be seen in the Figure.

The operation of the device described above is as follows. It is mounted on a support 37 which may be part of the fuel supply manifold, by inserting the lateral wall 26 of the body 1 into the housing 30; in this way the sealing ring 28 cooperating with the corresponding seat 29 of this housing prevents discharge of the fuel from the chamber 38 which is defined by the housing 30 and the body 1. The support 37 is advantageously provided with a hole 39 in which the end of the sleeve 7 is inserted and a sealing ring 40 is advantageously inserted between the support and the surface of the hole. The chamber 38 communicates via a hole 41 with the chamber in which the fuel pressure is to be kept constant (which chamber may be formed simply by the duct of the fuel supply manifold). When the pressure in this latter chamber exceeds a predetermined value, the fuel pressure within the chamber 5 applies pressures to the deformable membrane 3 which are high enough to overcome the elastic reaction of the spring 20, thereby allowing the shutter member 8 to be separated from the corresponding seat 13; the discharge of a certain quantity of fuel from the chamber 5 is thus enabled, which is sufficient to bring the fuel pressure to the desired value.

It is evident that the device of the invention has a very simple structure and comprises few components; connections for the supply of the fuel within the chamber 5 obtained in the body 1 are not, in particular, needed, since the fuel enters this chamber through the holes 25 provided in the base wall 22 of this body.

Moreover, the resultant of the pressures applied by the plate 16 to the shutter member 8 through the coupled surfaces 15 and 14 of these members coincides substantially with the direction of the axis of the device; in this way the working surface 12 of the shutter member bears correctly on the corresponding seat 13, preventing the discharge of fuel when the shutter member is in its closed position. This advantageous result is due in particular to the high surface finish and the very accurate machining of the support surface 15 of the plate 16 which, as mentioned above, is obtained by a coining operation; in addition the curved shape of this surface makes an efficient contribution to a uniform transmission of the pressures between the plate and the shutter member.

The sleeve 7 has a plurality of functions, since its upper edge generates the seat for the shutter member 8 and its collar 32 forms an axial stop for the shutter member, while the annular projections 35 with which it is provided oppose the destruction of the hole 33; the surface section of the sleeve 7 which is immediately above the collar 32 provides lastly for the centring of the spring 36.

The fastening of the device to the support 37 can take place, for example, by means of plates 42 fixed by screws 43 to the support.

It is evident that modifications and variants can be made both as regards the form and the arrangements of the various components of the device as described without departing from the scope of the invention.

We claim:

1. A pressure regulating device for a fuel circuit of an internal combustion engine supply system, said device comprising:

a valve housing formed by a cup-shaped body having a base wall including an axial hole and a lateral wall, and a bell-shaped cover secured to said body;

a circular plate disposed within said valve housing;

an annular deformable membrane having a peripheral edge locked between said body and said cover, and an inner edge secured to a peripheral edge of said circular plate;

a fuel chamber defined by said body, said membrane and said plate;

outlet means for external communication of fuel, said outlet means including an annular valve seat, said outlet means including a single tubular member tightly inserted into said axial hole of said base wall;

a shutter member having a planar working surface adapted for engaging and closing said valve seat, said shutter member further having a second oppositely disposed surface; and spring means for urging said plate against said opposite surface of said shutter member, said spring means including a support defining a mounting housing having a substantially cylindrical seat for locating said body, said spring means further including a sealing ring interposed between said cylindrical seat and an annular seat of said lateral wall for sealing an inlet chamber defined by said mounting housing and said base wall, said support having a fuel discharge hole receiving said tubular member and being coaxial with said plate and said axial hole of said base wall, at least one fuel inlet hole communicating with said inlet chamber, at least one communication hole on said base wall for allowing fuel in said inlet chamber to enter into said fuel chamber;

said opposite surface of said shutter member being substantially spherical and cooperating with an associated curved surface of said plate, said curved surface being shaped as a surface of revolution of a curved line having two curved portions with opposite curvatures separated by a flexure, whereby pressure applied by said spring means to said shutter member through said curved surface and said opposed surface is on the axis of said tubular member.

2. The device of claim 1 wherein said curved surface of said plate is obtained by a coining operation which produces a high surface finish.

3. The device of claim 1 wherein the outer surface of said tubular member includes a plurality of annular projections, each said annular projection having a frusto conical shape forming a forced connection with said axial hole, and an annular collar of said tubular member being housed in a corresponding annular seat of said base wall.

4. The device of claim 3 wherein the outer surface of said tubular member further includes an annular seat having a sealing ring disposed within to provide a sealed connection with said discharge hole.

5. The device of claim 1 wherein said inner edge of said membrane is locked between an annular edge of said plate and a rigid ring, said rigid ring being locked by a projection of said plate, and said projection being formed by plastic deformation of the material of said plate.

6. The device of claim 5 wherein said spring means includes a first helical spring located between said rigid ring and a base wall of said bell-shaped cover.

7. The device of claim 5 wherein said body is formed by metal material injected under pressure into a die and said cover is formed by sheet, said cover including a peripheral edge drawn and folded by plastic deformation operations to lock said peripheral edge on said body.

8. The device of claim 6 wherein said tubular member includes an annular collar housed in a corresponding annular seat of said base wall, and a sleeve portion located between said collar and said valve seat, said device further comprising a second helical spring coaxial with said sleeve portion and interposed between said collar of said sleeve and said shutter member, said second spring being centered on a portion of the outer surface of said sleeve.

* * * * *